US006293098B1

(12) United States Patent
Coates

(10) Patent No.: US 6,293,098 B1
(45) Date of Patent: Sep. 25, 2001

(54) METHOD AND APPARATUS FOR JOINING PRESSURIZED EXHAUST MANIFOLD SECTIONS

(76) Inventor: George J. Coates, Route 34 & Ridgwood Rd., Wall Township, NJ (US) 07719

( * ) Notice: Subject to any disclaimer, the term of this patent is extended or adjusted under 35 U.S.C. 154(b) by 0 days.

(21) Appl. No.: 09/649,926

(22) Filed: Aug. 29, 2000

(51) Int. Cl.[7] ..... F01N 7/10

(52) U.S. Cl. ..... 60/322; 60/323; 138/155; 285/370; 285/345

(58) Field of Search ..... 138/120, 155; 60/322, 323, 272; 285/370, 371, 351, 345

(56) References Cited

U.S. PATENT DOCUMENTS 4,644,747 * 2/1987 Petersen ..... 60/322
4,831,824 * 5/1989 Fuzakawa ..... 60/322
5,159,811 * 11/1992 Hefler et al. ..... 60/322
5,765,878 * 6/1998 Bonny et al. ..... 285/123.1
5,784,881 * 7/1998 Otsuka et al. ..... 60/322
6,134,886 * 10/2000 Bussmann et al. ..... 60/323
6,220,605 * 4/2001 Becker, Jr. ..... 277/591

* cited by examiner

*Primary Examiner*—Thomas Denion
*Assistant Examiner*—Binh Tran
(74) *Attorney, Agent, or Firm*—Clifford G. Frayne

(57) ABSTRACT

A joint assembly for a pressurized, multi-sectional exhaust manifold comprising a joint member, tubular in cross section having a first end and a second end and a throughbore extending therethrough, the outer circumference of the joint member being less than the inner circumference of adjoining exhaust manifold sections, there being formed on the joint member proximate the first end and the second end a plurality of circumferential grooves for receipt of a plurality of sealing rings, the joint member and sealing rings being frictionally secured within adjacent ends of exhaust manifold sections.

3 Claims, 2 Drawing Sheets

METHOD AND APPARATUS FOR JOINING PRESSURIZED EXHAUST MANIFOLD SECTIONS

BACKGROUND OF THE INVENTION

1. Field of the Invention

The present invention relates to exhaust manifolds, and in particular, to multi-sectioned, pressurized exhaust manifolds and pipes.

2. Description of the Prior Art

The exhaust manifold and associated exhaust piping serves to vent spent gases from an internal combustion engine. In a typical internal combustion engine, these gases might be vented to the atmosphere. However, in large diesel engines, they are often utilized to run associated equipment such as turbines. In that instance, the exhaust from the engine is pressurized and the piping or tubing which directs the pressurized spent gases to the turbine must be joined such that there is no leakage. In a perfect world, the exhaust piping and manifold would be of one piece construction having no sharp ends or curves, however, depending on the particular use, design compromises oftentimes have to be made while still considering the impact on the performance of the engine. Depending upon the engine, its size and the use to which it is put, the location, shape and length of the exhaust manifold and associated piping is an important component. Hence design parameters are carefully considered. When multi-section exhaust manifolds and pipes must be used, especially in a pressurized system where the engine expent gases are being utilized to drive a turbine, the joining of the multi-section piping becomes critical in order to avoid leaks. Typical bolt bracket and gasket assemblies have proved undesirable because of gasket failure and subsequent leaks which effectively reduces the effectiveness of the turbine and the efficiency of the turbine and requires significant down time in order to repair the leak.

Applicant has developed a novel joint member which allows for the easy assembly and disassembly of a pressurized exhaust manifold system and which is self-sealing and performs well in the intensive heat and pressure of a pressurized exhaust manifold and piping system.

OBJECTS OF THE INVENTION

An object of the present invention is to provide for a novel joint for securing adjacent sections of a pressurized exhaust manifold eliminating the need for gaskets.

Another object of the present invention is to provide for a novel joint for a pressurized exhaust manifold and piping which is self-sealing.

A still further object of the present invention is to provide for a novel joint for a pressurized exhaust manifold and piping of an engine which performs well under the intensive heat and pressure.

SUMMARY OF THE INVENTION

The invention comprises a tubular joint insert having an outer diameter approximating the interior diameter of the adjacent pipe sections of the manifold, the tubular joint insert having a plurality of circumferential groves proximate its longitudinal ends for the receipt of a plurality of sealing rings, said tubular joint insert and sealing rings frictionally secured in adjacent ends of the exhaust pipe sections permitting said adjacent pipe sections to be positioned distal proximate, said tubular joint insert and sealing rings securing said adjacent pipe ends and forming a seal.

BRIEF DESCRIPTION OF THE DRAWINGS

These and other objects of the present invention will become evident, particularly when taken in light of the following illustrations wherein.

DETAILED DESCRIPTION OF THE DRAWINGS

Figure 1:
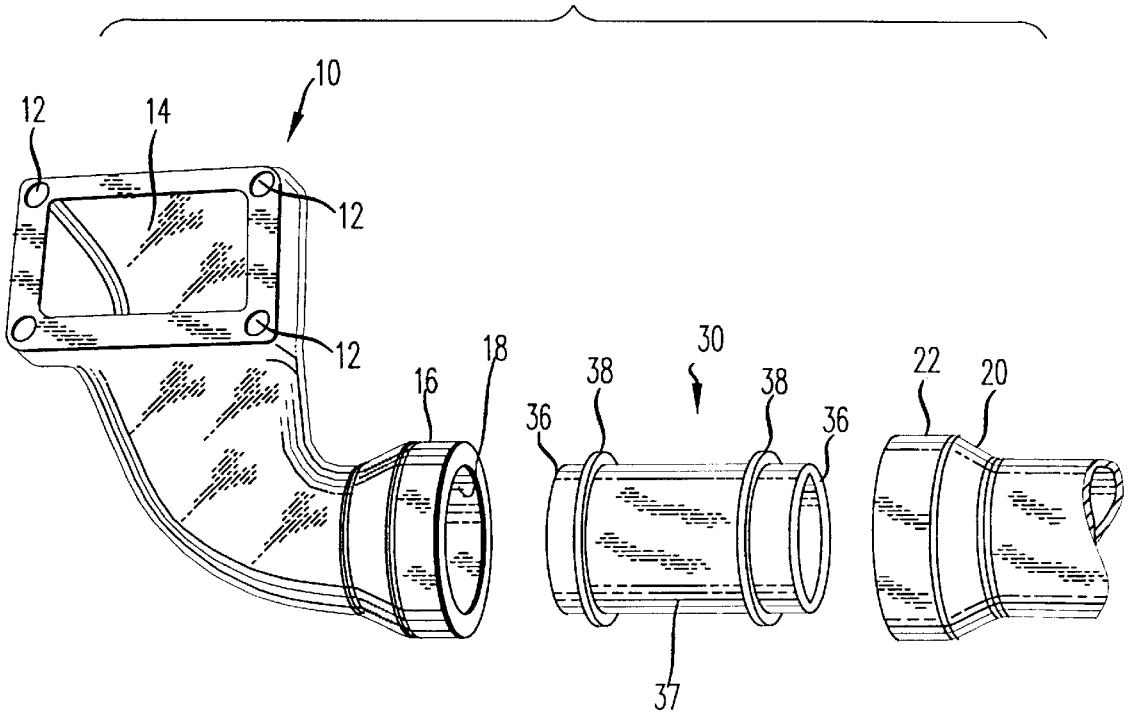
FIG. 1 is a perspective exploded view of the joint and adjacent exhaust pipe sections.

FIG. 1 is a perspective exploded view of the joint which is the subject matter of the present invention and adjacent exhaust pipe sections.

The exhaust pipe sections illustrated are constructed of cast iron or steel and are associated with large in-line diesel engines utilized to run turbines and hence the exhaust gases are pressurized. The first exhaust manifold member 10 is secured to the engine block (not shown) by means of a plurality of bolts (not shown) secured through a plurality of apertures 12 to the head. The exhaust gases from the engine would exit via exhaust openings 14. Exhaust manifold member 10 is arcuate in shape and terminates with a flared end 16 defining an exhaust opening 18. Exhaust member 10 would be joined at flared end 16 with the second exhaust member 20, which is tubular in shape having a flared end 22 and which would further direct the exhaust gases to another pipe member or to the atmosphere. The difficulty encountered is joining the first exhaust member 10 and second exhaust member 20 without contributing undue weight to the exhaust assembly and insuring proper sealing. This could be accomplished with a gasket and a plurality of brackets and fasteners which would join the flared ends 18 and 22. However this method would contribute undue weight to the exhaust assembly and the pressurized system leads to repeated gasket failure. Applicant's solution is a joint member 30. Joint member 30 is tubular in construction having an outer diameter slightly less than the inner diameter of opening 18 in first exhaust member 10 and the opening defined by flared end 22 of second exhaust member 20.

Formed on the outer circumference 32 of joint member 30 are a plurality of circumferential grooves 33 positioned proximate the ends 34 and 36 of tubular joint member 30. Grooves 33 are for receipt of a sealing ring 38 which is positioned within each groove, sealing ring 38 resembling a piston ring.

Figure 2:
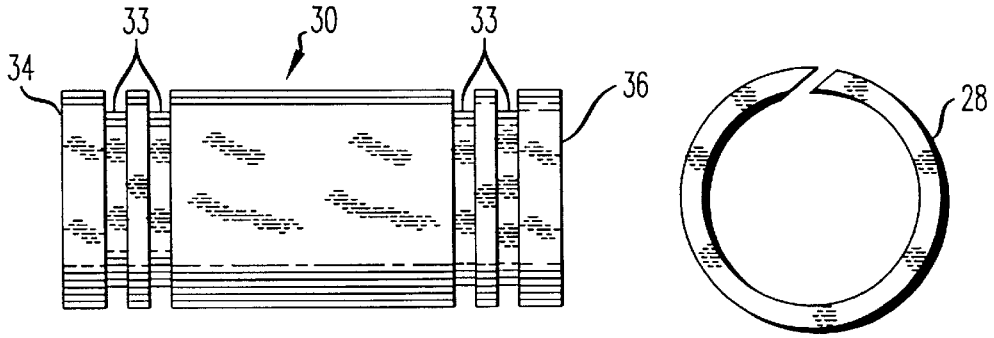
FIG. 2 is a side view of the joint.

FIG. 2 is a side view of the joint member 30 which illustrates the circumferential grooves 33 without the sealing rings 38 positioned therein, the sealing rings 38 are illustrated in a front view with the joint member.

Figure 3:
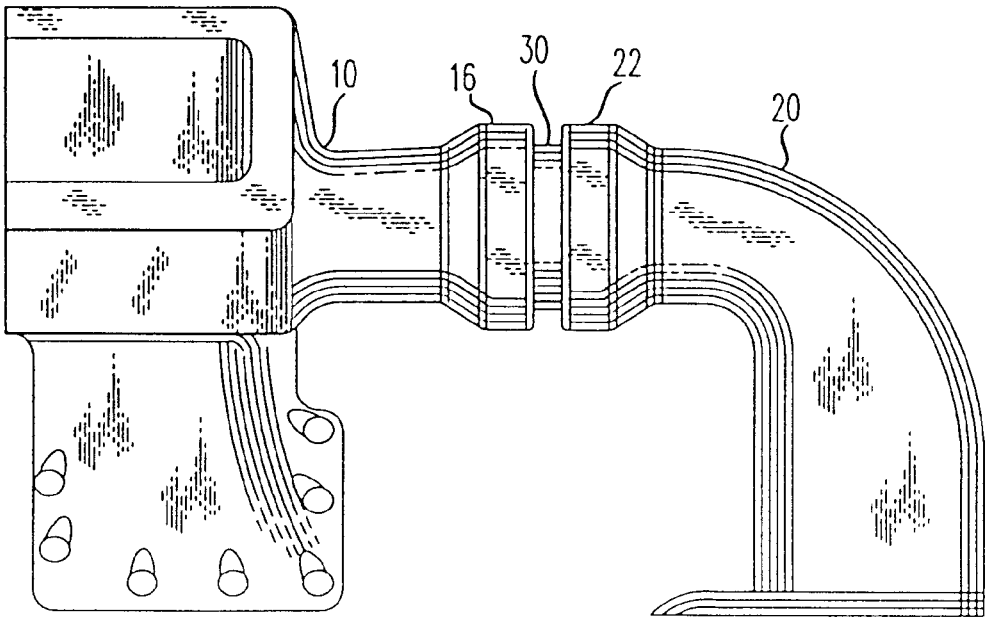
FIG. 3 is a side view of the installation of the joint.
Figure 4:
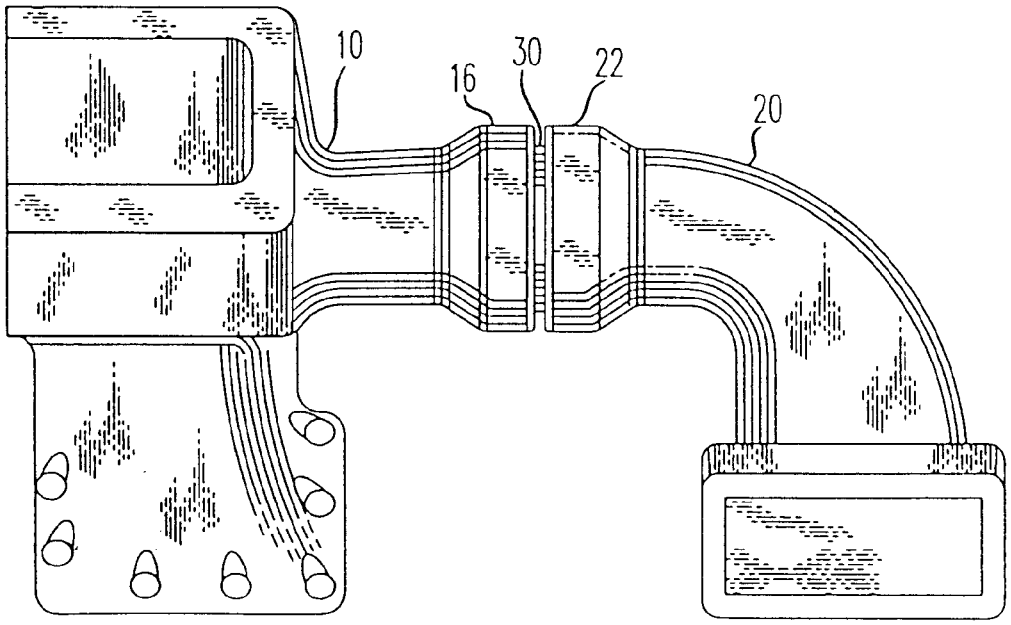
FIG. 4 is a side view of the sealed joint.

FIG. 3 is a side view of the installation of the joint with the first exhaust member 10 and the second exhaust member 20. With the sealing rings 38 affixed within the grooves 33 of the joint member 30, and 34 of joint member 30 is inserted into opening 18 of flared end 16 of first exhaust member 10. Sealing ring 38 frictionally engages the inner wall of opening 18 to position end 34 of joint member 30 in tight friction engagement with flared end 16. Second exhaust member 20 is then inserted over end 36 of joint member 30 such that sealing ring 38 engages the inner circumferential wall of second exhaust member 20. First exhaust member 10 and second exhaust member 20 are then forced together such that flared end 16 and flared end 22 are in distal contact as illustrated in FIG. 4 with the joint member 30 frictionally engaged with both members and securing the exhaust assembly. It will be recognized by those of ordinary skill in the art that the joint member 30 could similarly be inserted first into second exhaust member 20 and then into first exhaust member 10 without departing from the spirit and scope of the invention.

The joint member of the present invention provides for a quick and easy assembly and disassembly of an exhaust system without introducing any unwanted weight to the system and eliminate the need for gaskets. The sealing ring and joint member provide for a friction fit which not only secures the exhaust member components, but also insures that there will be no leaks from the exhaust assembly.

While the present invention has been described with respect to the preferred embodiment thereof, it will be recognized by those of ordinary skill in the art that many modifications and changes can be made without departing from the spirit and scope of the invention. It is therefore manifestly intended that the invention be limited only by the claims and the equivalents thereof.

I claim:

1. A joint assembly for pressurized, multi-sectional exhaust manifold assemblies comprising:

a tubular joint member having a first end and a second end and a throughbore extending therethrough, siad joint member having an outer circumference less than an inner circumference of adjoining exhaust manifold sections, there being formed on said joint member, proximate to said first end and said second end, two circumferential grooves for the receipt of two sealing rings at each end of said joint member, said joint member and said sealing rings being frictionally secured within adjacent ends of said exhaust manifold sections.

2. A multi-section, pressurized exhaust manifold assembly comprising:

a first exhaust manifold section secured to an engine block;

a plurality of exhaust manifold sections extending adjacently from said first exhaust manifold member;

a joint member securing adjacent exhaust manifold members, said joint member being tubular in cross-section having a first end and a second end and a throughbore therethrough, said joint member having two circumferential grooves formed proximate said first end and said second end for receipt of two sealing rings at each end of said joint member, said joint member frictionally engaged within adjacent ends of said pressurized exhaust manifold sections.

3. A method for joining adjacent sections of a multi-section, pressurized exhaust manifold assembly comprising:

a. forming a tubular joint member generally circular in cross-section having a first end and a second and and a throughbore therethrough;

b. forming two circumferential grooves on an exterior surface of said joint member proximate said first end and said second ends c. positioning in said grooves on said joint member sealing rings;

d. frictionally positioning said first end of said joint member within a throughbore of a first exhaust manifold section;

e. frictionally engaging said second end of said joint member within an adjacent throughbore of an adjacent exhaust manifold section; and f. forcing said adjacent ends of said manifold section together to surround said joint member.

* * * * *